US009595183B2

(12) United States Patent
Shahraz et al.

(10) Patent No.: US 9,595,183 B2
(45) Date of Patent: Mar. 14, 2017

(54) SYSTEM AND METHOD FOR DISTRIBUTION OF SENSORS FOR EMERGENCY RESPONSE

(71) Applicant: Safer Systems, LLC, Camarillo, CA (US)

(72) Inventors: Azar Shahraz, Camarillo, CA (US); Shahryar Khajehnajafi, Moorpark, CA (US)

(73) Assignee: SAFER SYSTEMS, LLC, Camarillo, CA (US)

( * ) Notice: Subject to any disclaimer, the term of this patent is extended or adjusted under 35 U.S.C. 154(b) by 51 days.

(21) Appl. No.: 14/621,345

(22) Filed: Feb. 12, 2015

(65) Prior Publication Data

US 2015/0310731 A1 Oct. 29, 2015

Related U.S. Application Data

(60) Provisional application No. 61/984,716, filed on Apr. 25, 2014.

(51) Int. Cl.
*G08B 29/18* (2006.01)
*G08B 21/12* (2006.01)

(52) U.S. Cl.
CPC ..... *G08B 29/18* (2013.01); *G08B 21/12* (2013.01)

(58) Field of Classification Search
CPC ..... G08B 29/18; G08B 21/12
USPC ..... 340/515, 584
See application file for complete search history.

(56) References Cited

U.S. PATENT DOCUMENTS 5,648,914 A * 7/1997 Bauer ..... G08B 21/14 702/19
8,304,740 B1 * 11/2012 Frank ..... G01V 5/0075 250/370.11
2002/0169557 A1 * 11/2002 Gilbert ..... G08B 21/14 702/3
2008/0122641 A1 * 5/2008 Amidi ..... G01N 33/0075 340/632
2011/0109464 A1 * 5/2011 Lepley ..... G01N 33/0075 340/605

* cited by examiner

*Primary Examiner* — Qutbuddin Ghulamali
(74) *Attorney, Agent, or Firm* — Lewis Roca Rothgerber Christie LLP

(57) ABSTRACT

A system and method for placement of sensors for sensing hazardous substances released from a plurality of hazard points. A processor identifies a location of a hazard point, a fence line of the plant-site, and a toxic level of concern (LOC) for the hazardous substance. The processor calculates a minimum amount of the hazardous substance (Q) for which a concentration at a centerline of a plume carrying the hazardous substance reaches the toxic LOC at the fenceline, and simulates a release of the hazardous substance in the calculated amount Q from the hazard point. The processor further calculates a pair of sensor locations where the concentration of the plume is equal to the minimum detectable concentration level of sensor based on the simulated release. The pair of sensor locations is then output by the processor.

22 Claims, 8 Drawing Sheets

400

402

| | 212 | 214 | 216 | Total |
|---|---|---|---|---|
| 200 | 1 | 0 | 0 | 1 |
| 202 | 1 | 0 | 0 | 1 |
| 204 | 0 | 1 | 0 | 1 |
| 206 | 0 | 1 | 1 | 2 |
| 208 | 0 | 1 | 1 | 2 |
| 210 | 0 | 0 | 1 | 1 |
| Total | 2 | 3 | 3 | |

404

FIG. 8

SYSTEM AND METHOD FOR DISTRIBUTION OF SENSORS FOR EMERGENCY RESPONSE

CROSS-REFERENCE TO RELATED APPLICATION

The present application claims the benefit of U.S. Provisional Application No. 61/984,716, filed on Apr. 25, 2014, the content of which is incorporated herein by reference.

BACKGROUND

The present invention is in the field of emergency response. More particularly, the present invention is in the technical field of sensor placement for community protection and notification to an industrial plant during actual chemical release events.

BRIEF SUMMARY

Embodiments of the present invention are directed to a system, and method for selecting placement of sensors for sensing a hazardous substance released from a plurality of hazard points. According to one embodiment, a processor identifies a location of a hazard point, a fenceline surrounding the hazard point, and a toxic level of concern (LOC) for the hazardous substance. The processor calculates a minimum amount of the substance (Q) for which a concentration at a centerline of a plume carrying the hazardous substance reaches the toxic LOC at the fenceline, and simulates a release of the hazardous substance in the calculated amount Q from the hazard point. The processor further calculates locations of a pair of sensors where concentration is equal to a minimum detectable level of concentration by the pairs of sensors based on the simulated release. The location of the pair of sensors is then output by the processor.

According to one embodiment of the invention, the location is identified two numbers in a Cartesian coordinate system. The first number corresponds to a downwind distance from the hazard point. The second number corresponds to a crosswind distance from the centerline of the plume, at the downwind distance from the hazard point.

According to one embodiment of the invention, the calculated locations are locations on the fenceline.

According to one embodiment of the invention, the release is simulated by running a dispersion model.

According to one embodiment of the invention, the processor assumes a wind direction in calculating the locations of the pair of sensors.

According to one embodiment of the invention, the processor assumes a wind rotation in calculating the locations of the pair of sensors.

According to one embodiment of the invention, the output location of the at least one sensor is stored in memory.

According to one embodiment of the invention, the processor identifies locations of other pairs of sensors associated with remaining hazard points in all calculated wind rotation angles. The processor identifies the sensors with overlapping coverage of the hazard points, and finds, from the identified sensors, sensors with maximum coverage of the hazard points. The processor further removes unnecessary sensors from the identified sensors.

According to one embodiment of the invention, the finding of the sensors is based on a criterion that determines the sensor with maximum source coverage.

According to one embodiment of the invention, the finding of the sensors is based on a criterion that identifies the sensor with a maximum number of wind directions for which the sensor is effective.

According to one embodiment of the invention, the finding of the sensor is based on the criterion that determines the sensor with maximum coverage length of the fenceline.

BRIEF DESCRIPTION OF THE DRAWING

FIG. 8 is a conceptual layout diagram of an exemplary sensor-source matrix according to one embodiment of the invention.

DETAILED DESCRIPTION

It is desirable to have an effective network of sensors at an industrial plant-site that carries hazardous chemicals to detect leak of such chemicals and provide early warning and protection of the exposed population. Accordingly, embodiments of the present invention are directed to a sensor placement system and method that are configured to calculate optimal number and location of sensors around an industrial plant-site carrying hazardous chemicals. The sensors may be, for example, a photoionization (PID), electrochemical, paper tape, open path, or any other type of sensors conventional in the art.

The plant-site may have simple or complex geometry and one or multiple hazard points. According to one embodiment, the sensor locations may be refined further considering the wind rose and population distribution around the plant-site. As a person of skill in the art will understand, wind rose is a graphic tool used by meteorologists to give a succinct view of how wind speed and direction are typically distributed at a particular location.

According to one embodiment, the sensor placement system and method are configured to find a minimum number of sensors on the boundaries of an industrial plant, that is determined to be effective in detecting a chemical release before such release begins to affect the surrounding communities. In this regard, a defined toxic level of concern (LOC) is identified for determining the location and number of sensors. According to one embodiment, the toxic LOC is defined either by a plant toxicologist or by using available published guidelines.

Figure 1:
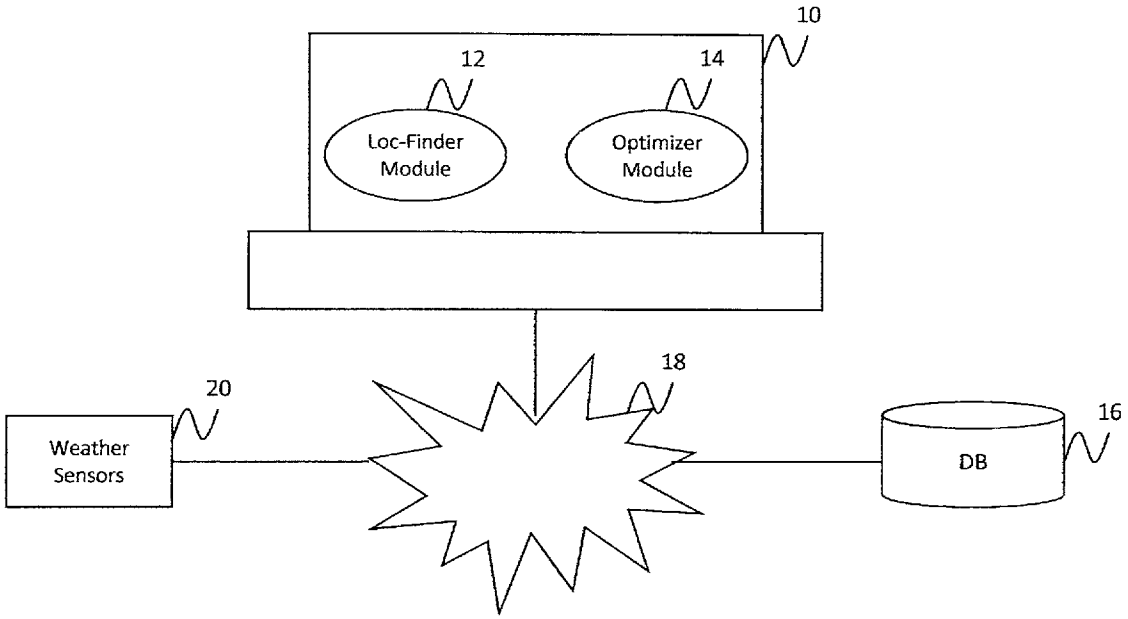
FIG. 1 is a block diagram of a sensor placement system according to one embodiment of the invention.

FIG. 1 is a block diagram of a sensor placement system according to one embodiment of the invention. The system includes a sensor placement server 10 coupled to a mass storage device 16 over a data communications network 18. The data communications network 18 may be a local area network (LAN), private wide area network (WAN), the Internet, or any wired or wireless network environment conventional in the art. The mass storage device may store information about one or more plant-sites for which sensor locations are to be determined, including for example, coordinates of a fenceline defining an outer perimeter of the plant site, location of hazard points, and the like.

According to one embodiment, the sensor placement server 10 may be further coupled to weather sensors 20 that provide meteorological data such as wind speed and direction to the computer over the wired or wireless data communications network 18. Such information may alternatively be obtained from other sources such as, for example, the Internet.

The sensor placement server 10 includes a central processing unit (CPU) executing software instructions and interacting with other system components to perform the instructions of the present invention. An input device such as mouse, keyboard or any type of user facilities can control the operation of the server.

The server 10 also includes an addressable memory for storing software instructions to be executed by the CPU. The memory is implemented using a standard memory device, such as a random access memory (RAM). In one embodiment, the memory stores a number of software objects or modules, including a location-finder module 12 and an optimizer module 14. Although these modules are assumed to be separate functional units, a person of skill in the art will recognize that the functionality of the modules may be combined or integrated into a single module, or further subdivided into further sub-modules without departing from the spirit of the invention.

According to one embodiment, the location-finder module 12 is configured to identify, for example, all possible locations of sensors to be placed on the fenceline of a plant-site. The optimizer module 14 is configured to optimize the output of the location-finder module and identify a necessary and sufficient number of sensors as well as their optimal locations on the plant-site for detecting releases from n hazardous points within the plant.

Figure 2:
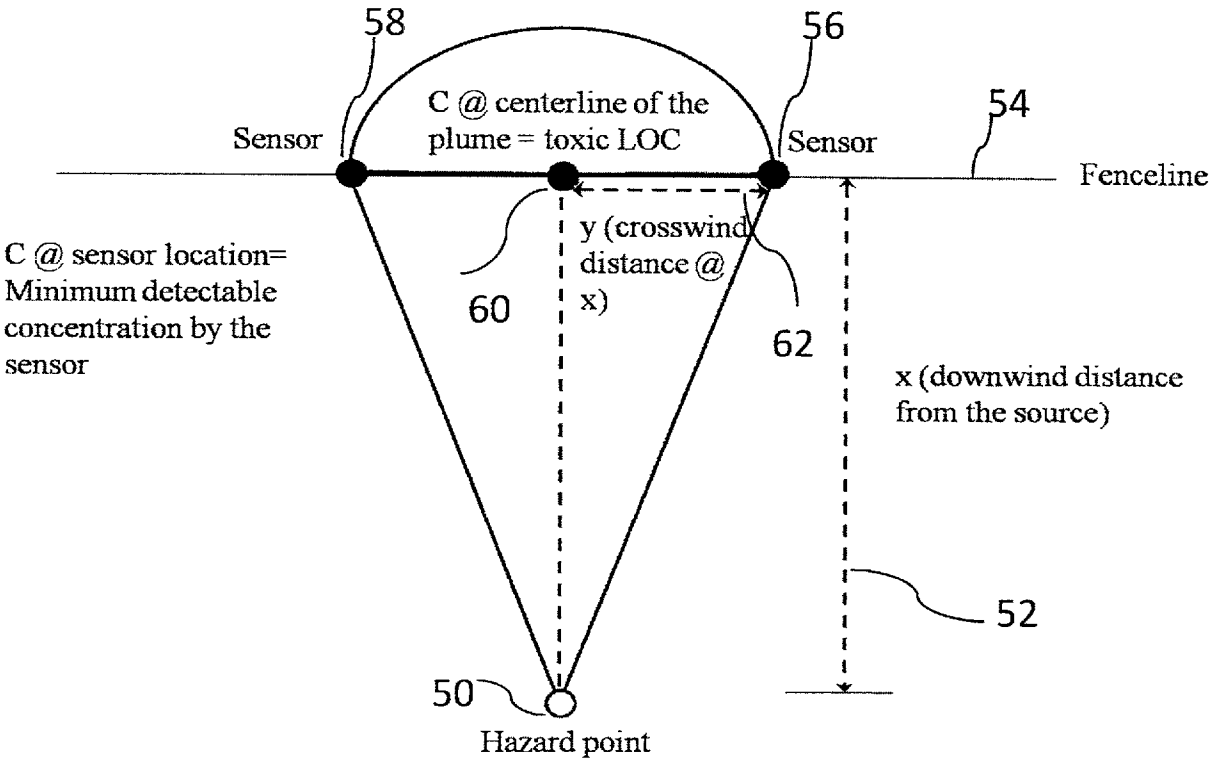
FIG. 2 is a conceptual diagram of sensor locations calculated by a location finder module according to one embodiment of the invention.

FIG. 2 is a conceptual diagram of a pair of sensor locations calculated by the location finder module 12 for detecting a release from a hazard point in one wind direction according to one embodiment of the invention. In the illustrated example, a particular hazard point (also referred to as a source) 50 is located a distance x 52 from a fenceline 54 of a particular plant-site. Such a distance is referred to herein as a downwind distance from the source. In determining the placement of a pair of sensors for a single hazard point, the location-finder module 12 identifies the location of the hazard point relative to the fenceline, and further identifies a toxic LOC for the hazardous substance at the hazard point 50. The location-finder module further calculates a minimum amount of the hazardous substance for which a concentration at a centerline of a plume 60 carrying the substance reaches the toxic LOC at the fenceline 54. According to one embodiment, the location-finder module 12 is configured to simulate the minimum amount of hazardous substance released from the hazard point 50, and identify intersections of the plume at the fenceline at points 56, 58 corresponding to the minimum detectable concentration of the substance by one or more sensors. The release simulation is done by running a dispersion model. Any dispersion model may be utilized for the sensor placement method described herein, such as the dispersion model disclosed in further detail in U.S. Pat. No. 6,772,071, the content of which is incorporated herein by reference. According to one embodiment, the location of the sensors at intersection points 56, 58 is obtained by calculating a crosswind distance 62 from the centerline (referred to as crosswind distance y), or the relative location of intersection points 56, 58 with respect to the hazard point 50.

Figure 3:
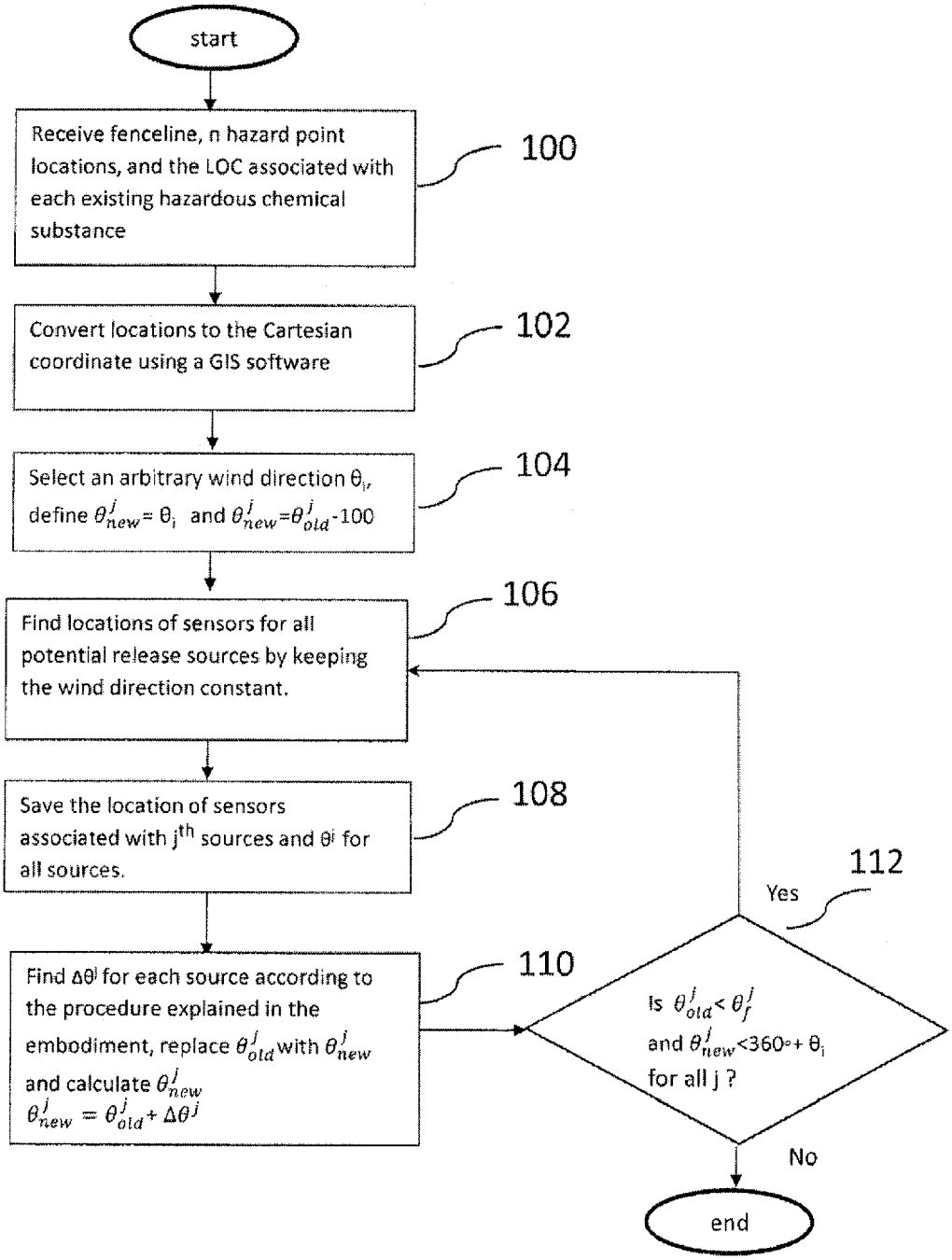
FIG. 3 is flow diagram of a process for finding all possible sensor locations according to one embodiment of the invention.

FIG. 3 is a flow diagram of a process for finding all possible sensor locations according to one embodiment of the invention. The process starts, and in step 100, the location-finder module 12 identifies the fenceline of a particular plant-site as well as the location of one or more hazard points within the plant where chemical substances are stored or processed. The fenceline may be defined via world coordinates corresponding to an outside perimeter of the particular plant-site, such as, for example, via latitude and longitude coordinates. According to one embodiment, information on the fenceline and location of the hazard points are retrieved from the mass storage device 16. Location of the hazard points are determined by a team with expertise in engineering and process operations, using appropriate hazard analysis techniques such as, for example, Process Hazard Analysts (PHA) as will be understood by a person of skill in the art.

In addition to the location of the fenceline and the hazard points, the location-finder module 12 also identifies the toxic level of concern (LOC) associated with each identified chemical substance. According to one embodiment, the toxic LOC is deemed to be the inhaled dosage of a chemical substance which causes injury to human population. Generally, the lower the toxic LOC value for a substance, the more toxic the substance is by inhalation.

According to one embodiment, the toxic LOC of a particular chemical substance is determined by a specialist in the plant-site, and stored in the mass storage device 16. According to this embodiment the location-finder module 12 is configured to retrieve the stored toxic LOC value for the particular chemical substance from the mass storage device 16.

In addition or in lieu of data provided by such specialist, the toxic LOC of a particular substance may be based on one or more industry guidelines. The guideline that is invoked may depend on a goal of assessing a threat due to a chemical release. For example, if the goal is protecting the general public, public exposure guidelines are used to assess the threat. Public exposure guidelines are intended to predict how members of the general public would be affected (that is, the severity of the hazard) if they are exposed to a particular hazardous chemical in an emergency response situation.

According to one embodiment, one of various public exposure guidelines stored in the mass storage device 16 is searched for finding the LOC of a particular substance. Such public exposure guidelines include but are not limited to:

AEGLs (Acute Exposure Guideline Levels)

ERPGs (Emergency Response Planning Guidelines)

TEELs (Temporary Emergency Exposure Limits)

Each of these guidelines provides three tiers of exposure values (e.g., ERPG-1, ERPG-2, and ERPG-3) for each chemical.

ERPG-2 is defined as the maximum airborne concentration below which nearly all individuals could be exposed for up to 1 hour without experiencing or developing irreversible or other serious health effects or symptoms that could impair an individual's ability to take protective action. According to one embodiment, the toxic level is determined by a specialist in the plant-site of concern, and those toxic level values are identified and retrieved from the mass storage device 16 by the location-finder module 12. However, if no toxic level has been set, the values of EKPG2s or AEGL2s may be applied as toxic thresholds.

In act 102, the locations of the fenceline and hazard points are each converted from a real-world geographic coordinate (e.g. latitude, longitude values) to Cartesian coordinates according to conventional mechanisms.

In act 104, the location-finder module 12 selects an arbitrary wind direction $\theta_i$ for determining the sensor location for a jth hazard location. According to one embodiment, $\theta_i$ represents an initial value for an array of wind direction ($\theta=[\theta_1\ \theta_2\ .\ .\ .\ \theta_n]$). According to one embodiment, two successive wind directions are maintained by the location-finder module when calculating placement of sensors for the plant-site: $\theta_{new}$ and $\theta_{old}$. A current wind direction is represented by $\theta_{new}$. An old wind direction is represented by $\theta_{old}$.

In act 106, the location-finder module 12 computes the location of pair of sensors for each potential release source by keeping the wind direction constant. Specifically, to find the location of the sensor for the jib hazard location and the current wind direction $\theta_{new}^j$, the location-finder module 12 computes a minimum amount of hazardous chemical (Q) for which a centerline concentration reaches the toxic LOC at the fenceline. According to one embodiment, the amount of hazardous chemical (Q) is calculated using Gaussian dispersion modeling according to Equation 1:

$$Q = \frac{2\pi\sigma_y\sigma_z uCe^{\frac{1}{2}\left(\frac{y}{\sigma_y}\right)^2}}{e^{-\frac{1}{2}\left(\frac{z-H}{\sigma_y}\right)^2} + e^{-\frac{1}{2}\left(\frac{z+H}{\sigma_y}\right)^2}} \tag{1}$$

Where:

C=ground level pollutant concentration (g/m$^3$)

Q=mass emitted per unit, time (g/s)

$\sigma_y$=standard deviation of pollutant concentration in y (horizontal) direction (m)

$\sigma_2$=standard deviation of pollutant concentration in z (vertical) direction (m)

u=wind speed (m/s)

y=distance in horizontal direction (m)

z=distance in vertical direction (m)

H=effective stack height (m)

$\sigma_y$ and $\sigma_z$ at are the standard deviation from normal on the Gaussian distribution curve in the y and z directions, respectively, and both are the function of atmospheric stability and downwind distance from the source. To find the minimum Q for a given ground level release, C is considered at toxic LOC, z and H are assumed to be zero and $\sigma_y$ and $\sigma_z$ are calculated for the worst-case weather condition defined as a very stable atmospheric condition (F stability) and a wind speed of, for example, 1.5 m/s. The most commonly used classification of atmospheric stability was developed by Pasquill and Gifford on 1961. They defined 6 classes, named A through F, with A the most unstable class, D neutral atmosphere and F the most stable class. According to one embodiment, for the stability class F and open (rural) terrain the following Equations 2 and 3 are applied for determining $\sigma_y$ and $\sigma_z$:

$$\sigma_y=0.04x(1+0.0001x)^{-0.5} \tag{2}$$

$$\sigma_z=0.016x(1+0.0003x)^{-1} \tag{3}$$

In this regard, the locations of the sensors are identified by simulating a release scenario by amount of Q from the jth hazard source and the wind direction $\theta_{new}^j$ and finding the intersection of a plume of the toxic release and the fenceline at points corresponding to the lower threshold of the sensor (the minimum detectable concentration of the sensor). According to one embodiment, the locations of the sensors are determined as x and y in the Cartesian coordinate system. In this regard, the x component of a sensor location corresponds to downwind distance x from the source (release location), and the y component is obtained by calculating the crosswind distance y from the centerline, at the downwind distance x of the hazard point from the release location, according to the following Equation 4:

$$y = \pm\sigma_y\left[2\ln\left(\frac{Q}{\pi\sigma_y\sigma_z uC_{sensor}}\right)\right]^{0.5} \tag{4}$$

where $C_{sensor}$ is the minimum detectable concentration of the substance by the sensor.

In act 108, the location-finder module 12 stores the location of the sensors for all of the sources in a matrix in the memory.

In act 110, the location-finder module 12 finds a new wind direction by rotating the wind direction $\Delta\theta^j$ from the last wind direction according to the following formula: $\theta_{new}^j=\theta_{old}^j+\Delta\theta^j$. The superscript j is the source indicator and can be varied from 1 to n, where n corresponds to the number of hazard points. According to one embodiment, $\Delta\theta^j$ the rotational angle of the wind in such a way that the leftmost edge of the plume, corresponding to the lower threshold limit of the sensor for the current wind direction, matches with the rightmost sensor obtained from a previous wind direction. According to one embodiment, $\Delta\theta^j$ is not constant but is determined by geometry.

In act 112, the location-finder module 12 determines whether $\theta_{old}^j>\theta_f^j$ OR $\theta_{new}^j>360°+\theta_i$ for j=1 . . . n, where $\theta_f^j$ is a final wind direction and determined by leftmost sensor locations associated with the initial wind direction ($\theta_i$). Calculations for jth hazard location end if $\theta_{old}^j>\theta_f^j$ OR $\theta_{new}^j>360°+\theta_i$.

The calculations performed by the location-finder module 12 to find the placement of a pair of sensors may be shown by the following example.

Example 1

If the toxic LOC of a hazardous chemical is 50 ppm, the lower threshold of the sensor is 1 ppm, the downwind distance from the release location (x) is 500 meters, and the wind speed is 1.5 m/s, the minimum amount of Q and location of two sensors (y@x) are obtained by following procedure:

@500 m:

$$\sigma_y=0.04\times500(1+0.0001\times500)^{-0.5}=19.52\ (m)$$

$$\sigma_z=0.016\times500(1+0.0003\times500)^{-1}=6.97\ (m)$$

@H=0 and z=0 the centerline (y=0) concentration of 50 ppm:

$$Q = \pi\times19.52\times6.97\times1.5\times50 = 32057\ \text{ppm}$$

-continued $$y = \pm 19.52\left[2\ln\left(\frac{32057}{\pi \times 19.52 \times 6.97 \times 1.5 \times 1}\right)\right]^{0.5} = 54.59 \text{ (m)}$$

As a person of skill in the art should appreciate, it is possible, due to the geometrical configuration of hazard points and fenceline, that a sensor specified for detecting the release from a particular hazard point and wind direction, is able to detect releases form other hazard points in the same or different wind direction. In this scenario, the one sensor may function for providing coverage for more than one hazard points. This scenario is hereinafter referred to as "overlapping coverage".

Figure 4:
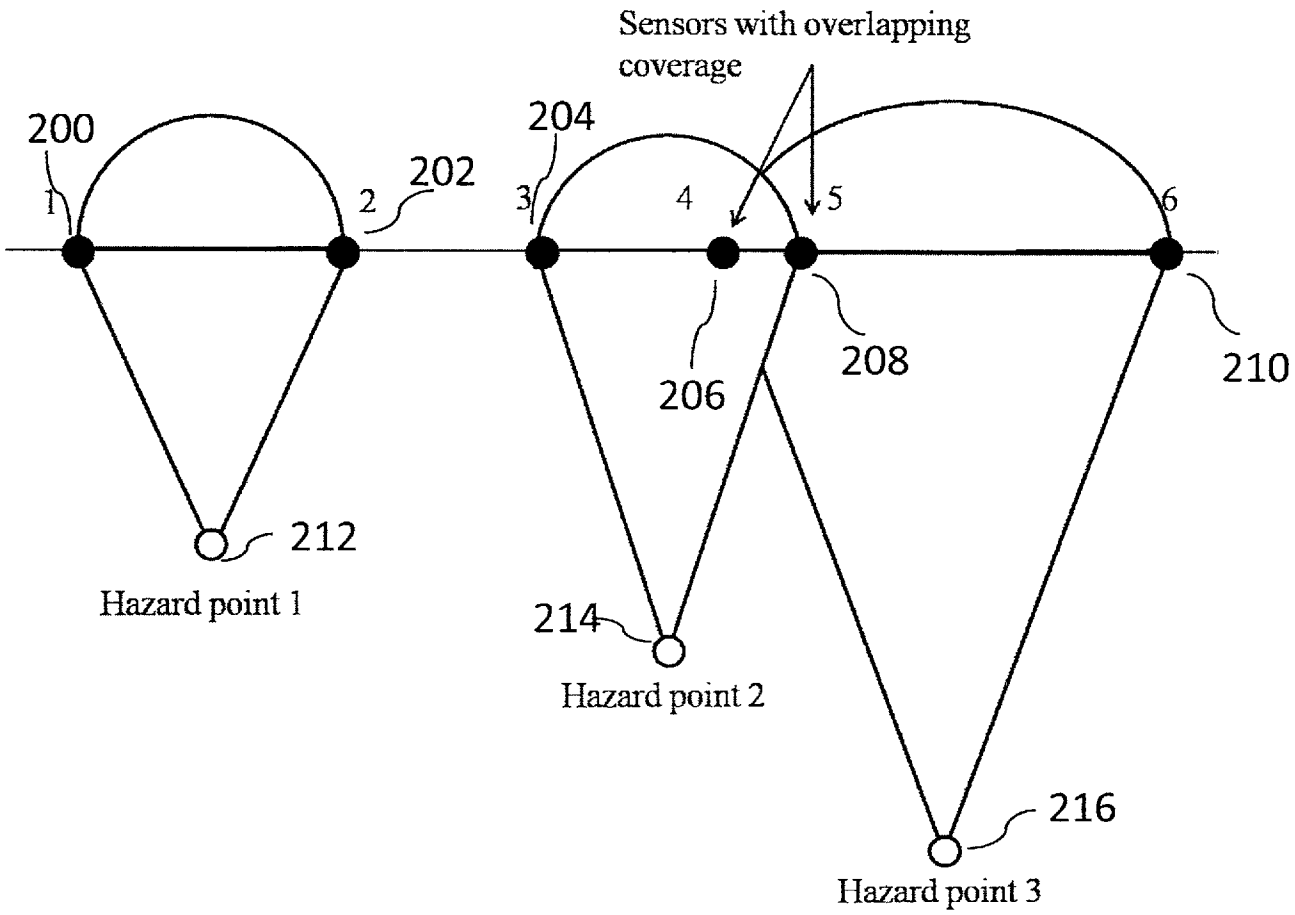
FIG. 4 is a conceptual layout diagram of exemplary sensors providing overlapping coverage according to one embodiment of the invention.

FIG. 4 is a conceptual layout diagram of exemplary sensors providing overlapping coverage according to one embodiment of the invention. In the example of FIG. 4 a plant-site includes three hazard points 212, 214, 216. It is assumed that the location-finder module 12 output locations of a pair of sensors for each of the three hazard points using the process described in FIG. 3, as follows: sensor locations 200, 202 used for detecting a release from hazard point 212; sensor locations 204, 208 are used for detecting a release from hazard point 204; and sensor locations 206 and 210 are used for detecting a release from hazard point 216. As shown in this example, one sensor (either sensor 200 or 202) is needed for detecting the release from hazard point 212. For the remaining four sensors 204-210, either sensor 206 or 208 is positioned to detect release from both hazard points 214 and 216. Thus, a minimum number of sensors needed for detecting a release from hazard points 212, 214, and 216, are two. Specifically, there are four appropriate combinations of sensors: (sensor 200 and sensor 208), (sensor 200 and sensor 206), (sensor 202 and sensor 208), and (sensor 202 and sensor 206). According to one embodiment, the optimizer module 14 selects the optimal combination of sensors based on one or more criteria while sensors that are not selected are removed from a final set of sensors needed to be placed on the fenceline.

Figure 5:
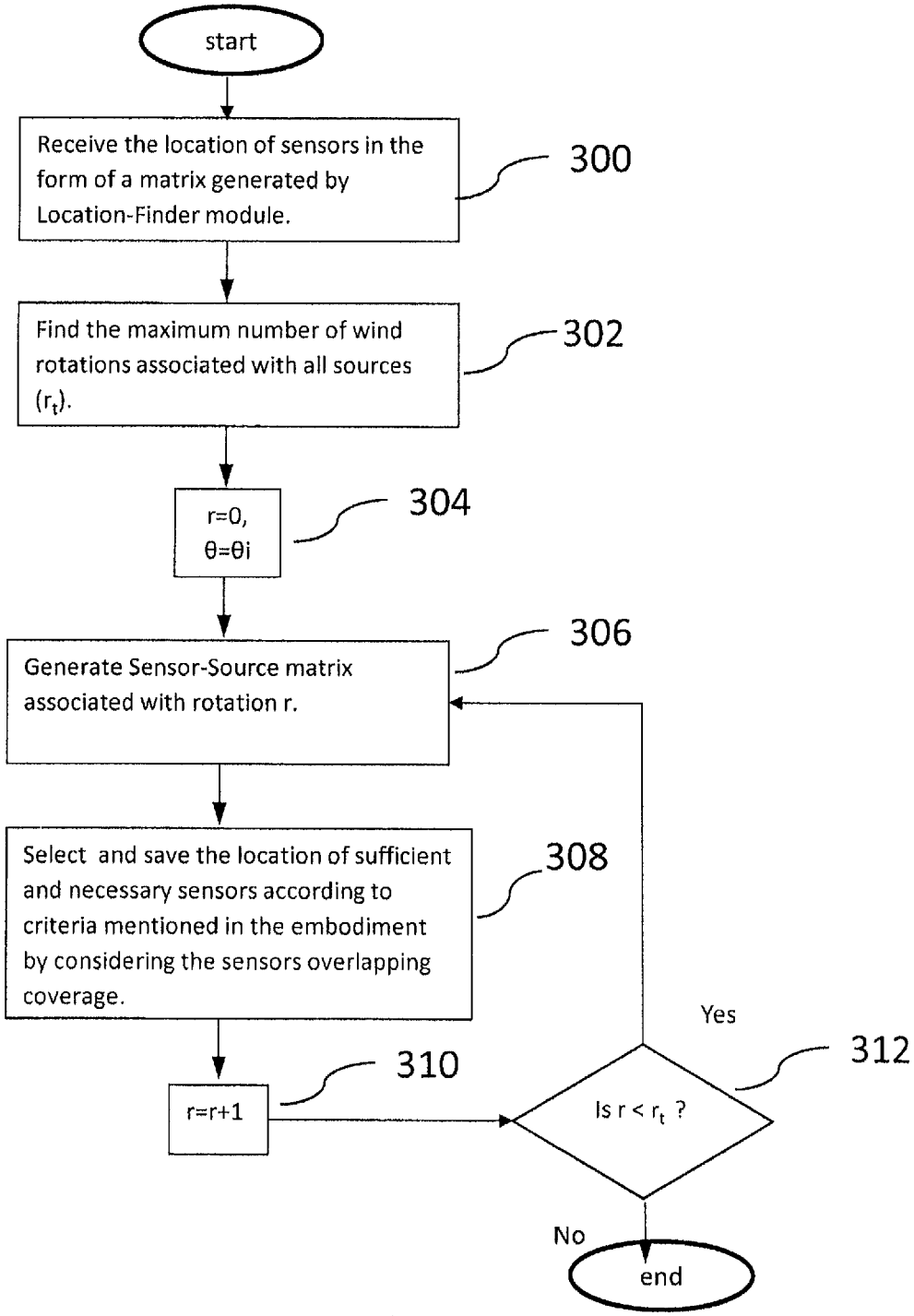
FIG. 5 is a flow diagram of a process for selecting an optimal combination of sensors for detecting release from any of hazardous locations according to one embodiment of the invention.

FIG. 5 is a flow diagram of process for selecting an optimal combination of sensors for detecting release from any of the n hazardous location based on a matrix of sensor locations output by the location-finder module 12 according to one embodiment of the invention.

The process starts, and in act 300, the optimizer module 14 receives the matrix of sensor locations from the location-finder module 12. According to one embodiment, the sensor location matrix contains information such as, for example, the location of sensors, the direction of the wind, the concentration, of the hazardous material at the centerline of the plume, and the like. According to one embodiment, one of the columns (e.g. the last column) of the matrix corresponds to the number of wind rotation's ($r_i$) associated with particular sources. Using the data of this column of the matrix, in act 302, the optimizer module identifies a maximum number of wind rotations ($r_i$) associated with the n hazardous sources. According to one embodiment, $r_i$ strongly depends on geometry of the plant-site, the LOG of the hazardous material, and the threshold of the sensor. According to one embodiment, act 302 also produces the sensor-rotation matrix, showing the number of wind rotations for which a specific sensor can be effective, regardless of which hazard source(s) is (are) being considered.

In act 304, an initial wind direction is identified and the current rotation r is initialized to 0.

In act 306, the optimizer module generates a sensor-source matrix for the current wind rotation. According to one embodiment, the sensor-source matrix shows how many sensors cover the release from specific sources as well as the number of sources that can be protected by a specific sensor.

The optimizer module 14 selects the collection of sensors among all entries of the sensor-location matrix for current rotation r. According to one embodiment, three following items are considered to "accept" or "reject" a sensor during act 306:

The number of sources that can be covered by the sensor in the wind direction of concern.

The number of wind directions for which release from any of one or multiple hazard locations can be detected by the sensor.

The length of the fenceline with respect to a fix point on the fenceline that can be covered by the sensor.

According to one embodiment, the above criteria are considered successively by the optimizer module 14 in accepting or rejecting a sensor to generate the collection of sensors with maximum source coverage. If there is more than one sensor with the same source coverage, the second criteria is applied to the collection of sensors satisfy the first criterion. Again, if more than one sensor is found by considering the second criteria, the sensor with maximum fenceline coverage is selected.

To automate this procedure, in each wind rotation, the optimizer module 14 generates the sensor-source matrix in act 306. The dimension of this matrix (m+1)×(n+1), where m is the number of sensors and n is the number of hazard points. The element Aij (0<i<=m and 0<j<=n) of the matrix is either 0 or 1, representing that the source j is covered by the sensor i (1) or not (0). $A_{(m+1)j}$ (0<j<=n) shows the total number of sensors that can cover source j, and $A_{i(n+1)}$ (0<i<=m) shows the total number of sources that can be covered by sensor i.

In act 308, this information along with the above-referenced criteria is used to "accept" sensor i in the final list of required sensors, or "reject" it because of the existing overlapping coverage. This matrix is created $r_i$ times by successively increasing each current rotation in act 310, where $r_i$ is the maximum number of wind direction for all sources. The process ends when the maximum number of wind rotations ($r_i$) have been reached.

FIG. 8 is a conceptual layout diagram of an exemplary sensor-source matrix 400 for the wind direction of FIG. 4 according to one embodiment of the invention. The sensor-source matrix identifies, for each hazard point (source) 212-216 and sensor ID 200-206 of FIG. 4, whether the sensor may detect a hazardous release from the particular hazard point. If so, a value of 1 is stored for the particular hazard point/sensor ID combination. Otherwise, a value of 0 is stored.

The matrix also includes a total source column 402 that identifies a sum of all entries of each row reflecting a total number of hazard points that may be identified by the sensors in each row. In the illustrated example, sensor 200 can detect a release from a total of 1 hazard point while sensors 206 and 208 can detect a release from a total of 2 hazard points. Further, the matrix includes row 404, which determines a total number of sensors associated with the detection of release from each source 212-216. In accepting or rejecting a sensor during act 306 of the process of FIG. 5, the optimizer module considers the first selection criterion, which is the number of sources that can be covered by the sensor in the wind direction of concern. According to first selection criterion, sensors 206 and 208 both can detect any release from two sources, so both of them are candidates to be selected for the rest of the procedure. Since more than one sensor is associated with the maximum coverage (in this example, 2 sources), the optimizer module considers the second criterion, which takes into account the number of wind directions for which release may be detected from any one or multiple hazard locations. To apply the second criterion, the optimizer module uses the sensor-rotation matrix. Assume, for purposes of this example, that the sensor-rotation matrix indicates that sensor 206 can be effective in detecting release from three wind directions and sensor 208 can be effective in detecting release from four wind directions. Because sensor 208 covers more wind directions than sensor 206, sensor 208 is selected to continue the rest of selection procedure.

According to the sensor-source matrix 400, sensor 208 can cover sources 214 and 216. The goal in each wind rotation is to find the minimum number of sensors that, when merged together, can build an array with "1" entries. According to the present example, by selecting sensor 208, there remains one "0" entry, which corresponds to source 212. According to the matrix 400, both sensors 200 and 202 may be selected as being capable of detecting a release from source 212. Since the coverage of both sensors are the same (i.e. each covers one source), the optimizer module applies the second criterion for selecting between the two sensors 200 and 202. Again, assume for purposes of the present example that both sensors can be effective in two wind rotations. Thus, the optimizer module applies the third criterion, which considers the clockwise arc distance of a sensor from a fixed point on the fenceline. According to the third criterion, a sensor is selected if the clockwise angle created by traveling from a fixed point on the fenceline toward the sensor is larger than those of other sensors. In this example, if the fenceline has a convex shape, the optimizer module selects sensor 202 based on the third criterion. By selecting sensors 202 and 208, all hazard points are assigned at least one sensor in the current wind rotation. The other sensors 200, 204, 206, and 210 are eliminated as providing overlapping coverage with sensors 202 and 208. The process is then repeated for other required wind directions.

Figure 6:
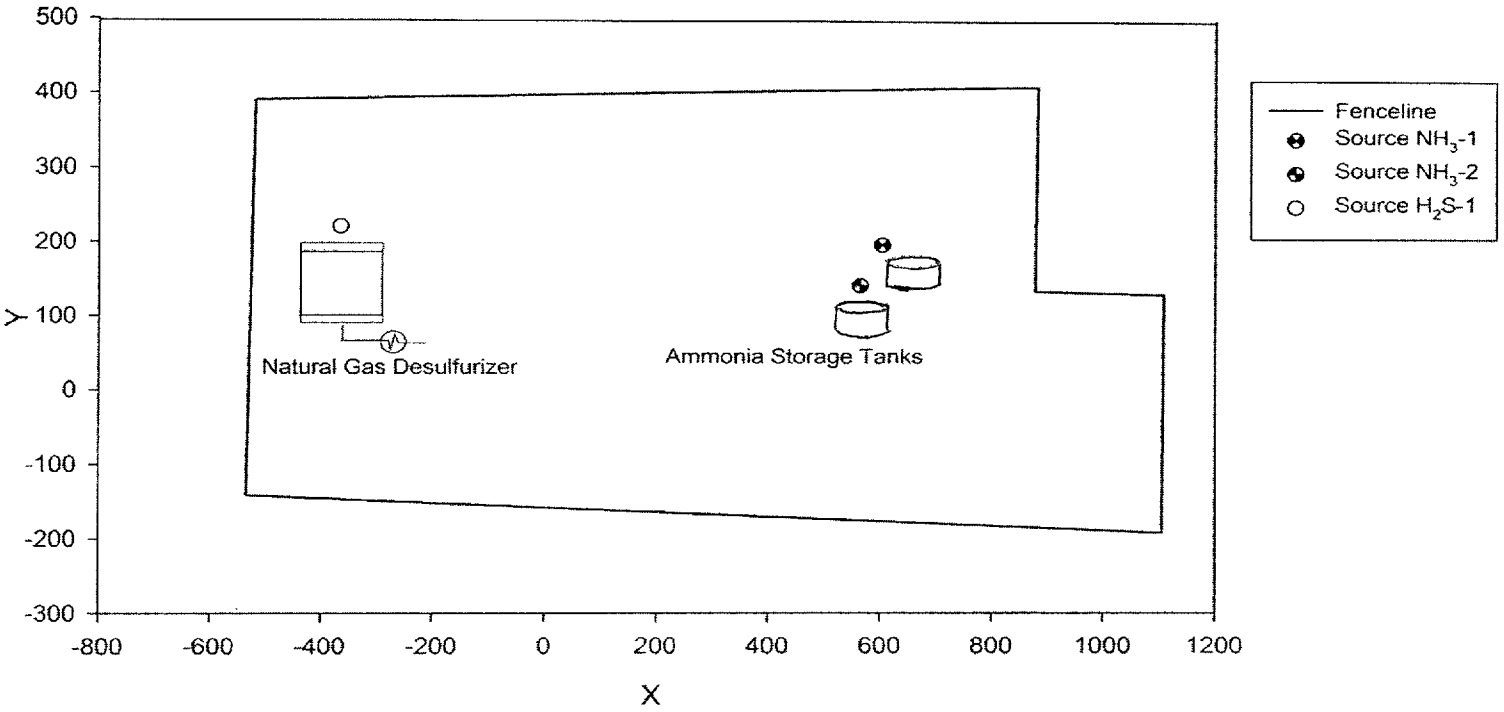
FIG. 6 is an example showing a map of a fenceline of a simulated plant site with three hazard points according to one exemplary embodiment.

FIG. 6 is a map of a fenceline of a simulated plant-site with three hazard points according to one exemplary embodiment. The hazard points include two ammonia hazard points ($NH_3$-1) and ($NH_3$-2) and one hydrogen sulfide hazard point ($H_2S$-1). A total number of 128 sensor locations are output by the location-finder module 12 based on these hazard points. The sensor locations may be output as x and y coordinates of a Cartesian coordinate system. According to one embodiment, the server 10 is configured to convert the x and y coordinates to real-world geographic coordinates for actual placement of sensors in the identified geographic locations.

Figure 7:
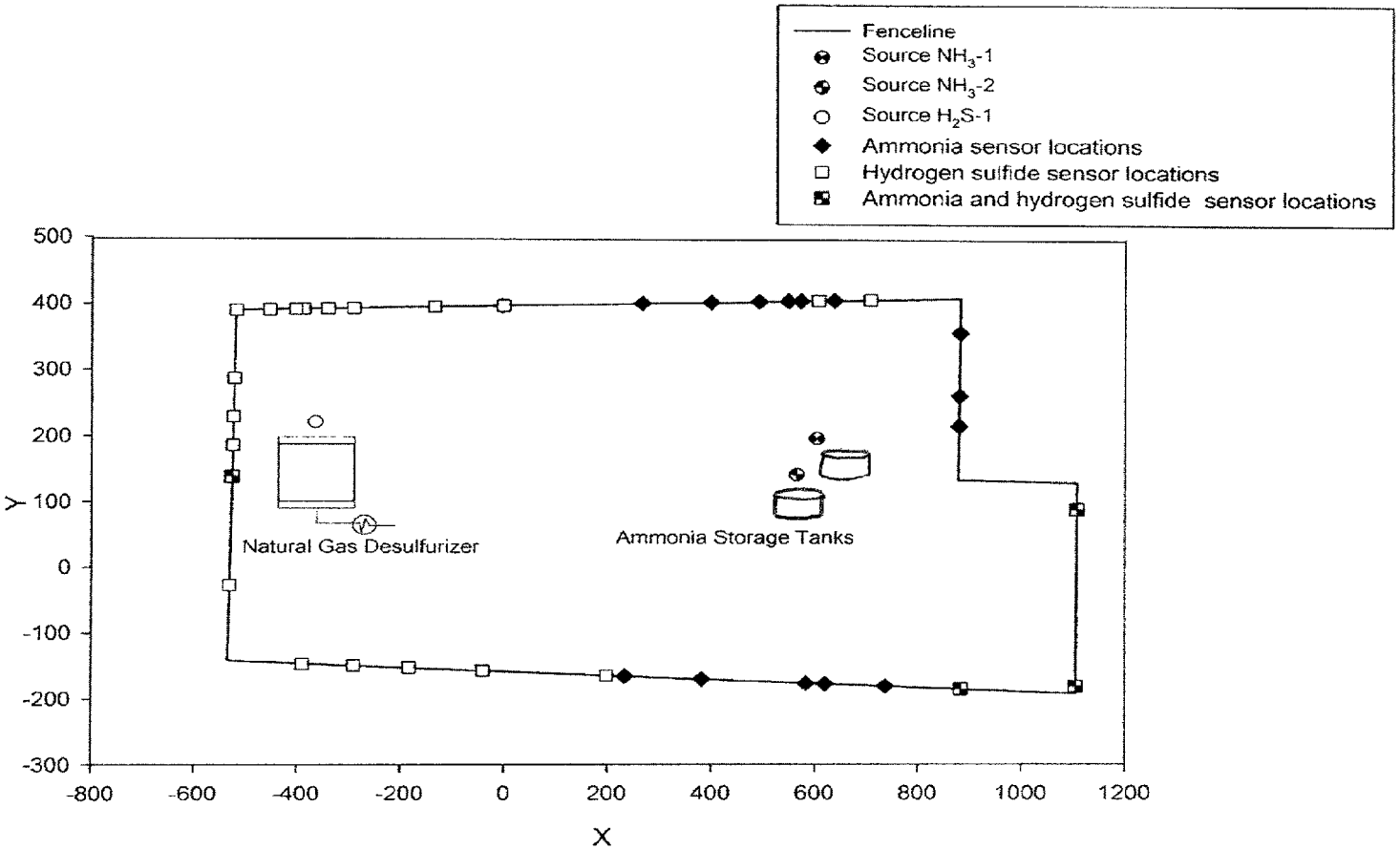
FIG. 7 is a map of the simulated plant site of FIG. 6 with locations of sensors after being optimized via the process of FIG. 5 according to one exemplary embodiment.

FIG. 7 is a map of the simulated plant-site of FIG. 6 with locations of sensors after being optimized by the optimizer module 14. In this example, the output of the optimizer module 14 is as follows: 15 locations in which ammonia sensor are to be installed; 4 locations in which both ammonia and hydrogen sulfur sensors should be installed, and 18 locations in which hydrogen sulfide sensors should be installed.

The total number of sensors (considering all chemical substances) may be reduced even more by taking into consideration the wind rose and the location of communities. For example, if the wind rose of a plant-site shows that the frequency of winds blowing from particular directions are extremely low, or there is no community in a particular region around the plant-site, the location-finder module 12 or optimizer module 14 may be configured to eliminate sensor locations associated with this particular wind direction or region. According to the example for this plant-site, the population distribution is assumed to be uniform in the neighborhood, and there is no preferred wind direction.

It is the Applicant's intention to cover by claims all such uses of the invention, and those changes and modifications which could be made to the embodiments of the invention herein chosen for the purpose of disclosure without departing from the spirit and scope of the invention. Thus, the present embodiments of the invention should be considered in all respects as illustrative and not restrictive, the scope of the invention to be indicated by claims and their equivalents rather than the foregoing description.

The invention claimed is:

1. A system for selecting placement of sensors for sensing a hazardous substance released from a plurality of hazard points, the system comprising:

a processor; and a memory, wherein the memory has instructions stored therein that, when executed by the processor, cause the processor to:

identify a location of a hazard point;

identify a fenceline surrounding the hazard point;

identify a toxic level of concern (LOC) for the hazardous substance;

calculate a minimum amount of the hazardous substance (Q) for which a concentration at a centerline of a plume carrying the hazardous substance reaches the toxic LOC at the fenceline;

simulate a release of the hazardous substance in the calculated amount Q from the hazard point;

calculate, based on the simulated release, locations of a pair of sensors where concentration is substantially equal to a minimum level of concentration detectable by the pair of sensors; and output the locations of the pair of sensors for prompting placement of the pair of sensors at the locations.

2. The system of claim 1, wherein the location is identified via two numbers in a Cartesian coordinate system, a first one of the two numbers corresponding to a downwind distance from the hazard point, and a second one of the two numbers corresponding to a crosswind distance from the centerline of the plume, at the downwind distance from the hazard point.

3. The system of claim 1, wherein the calculated locations are locations on the fenceline.

4. The system of claim 1, wherein the instructions that cause the processor to simulate the release include instructions that cause the processor to run a dispersion model.

5. The system of claim 1, wherein the instructions cause the processor to assume a wind direction in calculating the locations of the pair of sensors.

6. The system of claim 1, wherein the instructions cause the processor to calculate a degree of wind rotation in calculating the locations of the pair of sensors.

7. The system of claim 1, wherein the output locations of the pair of sensors is stored in the memory.

8. A system for selecting placement of sensors for sensing a hazardous substance released from a plurality of hazard points, the system comprising:

a processor; and a memory, wherein the memory has instructions stored therein that, when executed by the processor, cause the processor to:

identify a location of a hazard point;

identify a fenceline surrounding the hazard point;

identify a toxic level of concern (LOC) for the hazardous substance;

calculate a minimum amount of the hazardous substance (Q) for which a concentration at a centerline of a plume carrying the hazardous substance reaches the toxic LOC at the fenceline;

simulate a release of the hazardous substance in the calculated amount Q from the hazard point;

calculate locations of a pair of sensors where a minimum level of concentration of the hazardous substance is detected by the pair of sensors based on the simulated release;

output the locations of the pair of sensors;

identify locations of other pairs of sensors associated with remaining hazard points in all calculated wind rotation angles;

identify the sensors with overlapping coverage of the hazard points;

find, from the identified sensors, sensors with maximum coverage of the hazard points; and remove unnecessary sensors from the identified sensors.

9. The system of claim 8, wherein the finding of the sensors is based on a criterion that determines the sensor with maximum source coverage.

10. The system of claim 8, wherein the finding of the sensors is based on a criterion that identifies the sensor with a maximum number of wind directions for which the sensor is effective.

11. The system of claim 8, wherein the finding of the sensors is based on a criterion that determines the sensor with maximum coverage length of the fenceline.

12. A method for selecting placement of sensors for sensing a hazardous substance released from a plurality of hazard points, the method comprising:

identifying, by a processor, a location of a hazard point;

identifying, by the processor, a fenceline surrounding the hazard point;

identifying, by the processor, a toxic level of concern (LOC) for the hazardous substance;

calculating, by the processor, a minimum amount of the hazardous substance (Q) for which a concentration at a centerline of a plume carrying the hazardous substance reaches the toxic LOC at the fenceline;

simulating, by the processor, a release of the hazardous substance in the calculated amount Q from the hazard point;

calculating, based on the simulated release, by the processor, locations of a pair of sensors where concentration is substantially equal to a minimum level of concentration detectable by the pair of sensors; and outputting, by the processor, the locations of the pair of sensors for prompting placement of the pair of sensors at the locations.

13. The method of claim 12, wherein the location is identified via two numbers in a Cartesian coordinate system, a first one of the two numbers corresponding to a downwind distance from the hazard point, and a second one of the two numbers corresponding to a crosswind distance from the centerline of the plume, at the downwind distance from the hazard point.

14. The method of claim 12, wherein the calculated locations are locations on the fenceline.

15. The method of claim 12, wherein the release is simulated by running a dispersion model.

16. The method of claim 12, wherein the processor assumes a wind direction in calculating the locations of the pair of sensors.

17. The method of claim 12, wherein the processor calculates a degree of wind rotation in calculating the locations of the pair of sensors.

18. The method of claim 12, wherein the output locations of the pair of sensors is stored in memory.

19. A method for selecting placement of sensors for sensing a hazardous substance released from a plurality of hazard points, the method comprising:

identifying, by the processor, a location of a hazard point;

identifying, by the processor, a fenceline surrounding the hazard point;

identifying, by the processor, a toxic level of concern (LOC) for the hazardous substance;

calculating, by the processor, a minimum amount of the hazardous substance (Q) for which a concentration at a centerline of a plume carrying the hazardous substance reaches the toxic LOC at the fenceline;

simulating, by the processor, a release of the hazardous substance in the calculated amount Q from the hazard point;

calculating, by the processor, locations of a pair of sensors where concentration is equal to a minimum detectable level of concentration by the pairs of sensors based on the simulated release;

outputting, by the processor, the locations of the pair of sensors;

identifying, by the processor, locations of other pairs of sensors associated with remaining hazard points in all calculated wind rotation angles;

identifying, by the processor, the sensors with overlapping coverage of the hazard points;

finding, by the processor, from the identified sensors, sensors with maximum coverage of the hazard points; and removing, by the processors, unnecessary sensors from the identified sensors.

20. The method of claim 19, wherein the finding of the sensors is based on a criterion that determines the sensor with maximum source coverage.

21. The method of claim 19, wherein the finding of the sensors is based on a criterion that identifies the sensor with a maximum number of wind directions for which the sensor is effective.

22. The method of claim 19, wherein the finding of the sensors is based on a criterion that determines the sensor with maximum coverage length of the fenceline.

* * * * *